US006813814B1

(12) United States Patent
Schultz

(10) Patent No.: US 6,813,814 B1
(45) Date of Patent: Nov. 9, 2004

(54) CLIP APPARATUS

(75) Inventor: Gary R. Schultz, Kalamazoo, MI (US)

(73) Assignee: GRSchultz Consultanting, LLC, Kalamazoo, MI (US)

( * ) Notice: Subject to any disclaimer, the term of this patent is extended or adjusted under 35 U.S.C. 154(b) by 0 days.

(21) Appl. No.: 10/366,228

(22) Filed: Feb. 13, 2003

(51) Int. Cl.[7] ..... A44B 21/00
(52) U.S. Cl. ..... 24/560; 24/545; 24/570
(58) Field of Search ..... 24/30.5 R, 67.3, 24/67.5, 67.7, 67.9, 67 R, 530, 535, 536, 538, 545, 546, 560, 552–555, 565, 568, 570, 571; 81/318–320, 323–325, 336–338; 100/234; 606/116, 117, 151, 157, 153, 136–138, 164, 205–507

(56) References Cited

U.S. PATENT DOCUMENTS

| | | | | | |
|---|---|---|---|---|---|
| 3,078,367 | A | | 2/1963 | Jackson | 362/296 |
| 3,302,648 | A | * | 2/1967 | Nelson | 606/158 |
| 3,629,912 | A | * | 12/1971 | Klopp | 24/457 |
| 3,733,656 | A | * | 5/1973 | Stalder | 24/557 |
| 3,845,521 | A | * | 11/1974 | Mc Nichol | 3/67.9 |
| 4,277,863 | A | * | 7/1981 | Faneuf | 24/3.12 |
| 4,277,864 | A | * | 7/1981 | Orson, Sr. | 24/327 |
| 4,356,600 | A | | 11/1982 | Welch | 24/30.5 R |
| 4,394,791 | A | | 7/1983 | Groth | 24/30.5 R |
| 4,493,495 | A | * | 1/1985 | Linn | 24/535 |
| 4,524,992 | A | * | 6/1985 | Linn | 24/487 |
| 4,660,750 | A | | 4/1987 | Blanchard | 223/91 |
| 4,763,388 | A | | 8/1988 | Kemble | 24/30.5 R |
| 4,803,759 | A | | 2/1989 | Kemble | 24/30.5 R |
| 4,839,947 | A | * | 6/1989 | Cohen et al. | 24/499 |
| 5,044,050 | A | * | 9/1991 | Trinkaus | 24/499 |
| 5,305,500 | A | | 4/1994 | Tucker | 24/30.5 R |
| 5,361,463 | A | * | 11/1994 | Revis | 24/543 |
| 5,452,500 | A | * | 9/1995 | Revis | 24/543 |
| 5,655,270 | A | * | 8/1997 | Boisvert | 24/336 |
| 5,802,677 | A | | 9/1998 | Dorman et al. | 24/30.5 R |
| 6,210,419 | B1 | * | 4/2001 | Mayenberger et al. | 606/158 |
| 6,261,303 | B1 | * | 7/2001 | Mayenberger et al. | 606/151 |
| 6,266,854 | B1 | * | 7/2001 | Ancona et al. | 24/499 |
| 6,397,439 | B1 | * | 6/2002 | Langford | 24/518 |
| 6,484,374 | B2 | | 11/2002 | McAllister et al. | 24/557 |
| 2001/0017948 | A1 | | 8/2001 | Gross et al. | 383/80 |
| 2002/0078534 | A1 | | 6/2002 | Williams | 24/30.5 S |
| 2002/0083560 | A1 | | 7/2002 | Mennito | 24/30.5 S |
| 2003/0005555 | A1 | | 1/2003 | Comer et al. | 24/30.5 R |

* cited by examiner

*Primary Examiner*—Robert J. Sandy
*Assistant Examiner*—Ruth C. Rodriguez
(74) *Attorney, Agent, or Firm*—King & Jovanovic, PLC

(57) ABSTRACT

A clip apparatus comprising a pair of opposing clip members, an attachment assembly and a biasing member. Each clip member includes an outer surface and an inner surface, a proximal end and a distal end, and side edges extending substantially from the proximal end to the distal end. The attachment assembly is capable of attaching the pair of opposing clip members between the proximal and distal ends thereof, to facilitate pivoting thereabout. The biasing member comprises a central region, a pair of opposing leg regions extending away from the central region, and an attachment assembly capable of pivotably attaching the opposing end regions to opposing clip members substantially about the proximal end thereof. Upon assembly of the clip apparatus, the biasing member substantially biases against the proximal ends of the respective clip members, to, in turn, force the distal ends of the respective clip members into abutment.

13 Claims, 3 Drawing Sheets

CLIP APPARATUS

BACKGROUND OF THE INVENTION

1. Field of the Invention

The present invention relates in general to clip apparatuses, and in particular to a clip apparatus having a biasing member associated with one end of the clip apparatus. In a preferred embodiment, the clip apparatus comprises a single integrally molded assembly, thereby facilitating molding and assembly thereof.

2. Background Art

The use of clip apparatuses has been known in the art for many years. Generally, clip apparatuses comprises a pair of opposing clip members which are pivotally attached in a configuration wherein two ends of the clip members are biased toward each other. Generally, metal springs are utilized (i.e., torsion springs or clip springs) and attached to each of the opposing clip members to achieve the desired biasing of the clip members toward each other. One such clip apparatus is shown in U.S. Pat. No. 5,802,677 issued to Dorman et al.

While such clips have had some success, problems have been evident. For example, many such clip apparatuses include inherently weak regions proximate the attachment regions wherein the relatively strong, metal springs are attached to the opposing clip members (usually made from a plastic material). Accordingly, premature failure is often exhibited near such attachment regions. Additionally, the clips generally required a relatively expensive and labor intensive assembly procedure, wherein a manual union of the springs and the opposing clip members is required.

Accordingly, it is an object of the invention to overcome the deficiencies in the prior art. For example, it is an object of the present invention to improve the assembly of clip apparatuses.

It is an additional object of the present invention to improve the structural configuration of a spring relative to opposing clip members of a clip apparatus.

These objects as well as other objects of the present invention will become apparent in light of the present specification, claims, and drawings.

SUMMARY OF THE INVENTION

The invention comprises a clip apparatus which, in turn, comprises a pair of opposing clip members, an attachment assembly and a biasing member. Each clip member includes an outer surface and an inner surface opposing the outer surface, a proximal end and a distal end spaced apart from the proximal end, and side edges extending substantially from the proximal end to the distal end. The attachment assembly is capable of attaching the pair of opposing clip members between the proximal and distal ends thereof, to facilitate pivoting thereabout. The biasing member comprises a central region, a pair of opposing leg regions and an attachment assembly. The pair of opposing leg regions extend away from the central region. The attachment assembly is capable of pivotally attaching the opposing end regions to opposing clip members substantially about the proximal end thereof. Upon assembly of the clip apparatus, the biasing member substantially biases against the proximal ends of the respective clip members, to, in turn, force the distal ends of the respective clip members into abutment.

In a preferred embodiment, the clip member further includes side walls extending about either side edge of the respective clip member at least partially between the proximal end and the distal end of the respective clip member. Furthermore, in such an embodiment the side walls positioned such that the side walls of one of the clip members can be nested relative to the side walls of the other of the clip members. Additionally, the attachment assembly further comprises at least one slot associated with one of the side walls of one clip member and at least one tab associated with an adjoining side wall of the other clip member. In turn, the at least one slot interfaces with the at least one tab so as to facilitate pivoted rotational engagement of the clip members relative to each other.

In one such embodiment, each of the side walls of one clip member include at least one tab, and each of the side walls of the other clip member include at least one slot. The tabs of one clip member interface with the slots of the other clip member, to facilitate pivoted rotational engagement of the clip members relative to each other.

In one preferred embodiment, the distal end of at least one clip member comprises a material softer than the remainder of the at least one clip member.

In another preferred embodiment, the attachment assembly of the biasing member comprises a first hinge integrally molded to one of the pair of opposing leg regions and to one of the clip members, and a second hinge integrally molded to the other of the pair opposing leg regions and to the other of the clip members. In one such embodiment, the hinges are integrally molded to the respective clip member at the proximal edges thereof.

In yet another preferred embodiment, the biasing member further comprises a secondary attachment assembly. Preferably, the secondary attachment assembly further comprises one of a hole and a post associated with each of the opposing leg regions and the other of a hole and a post associated with each of the respective clip members. Upon assembly of the clip apparatus, the respective holes and posts interface with each other to facilitate attachment of the biasing member to the clip members.

In another such embodiment, the attachment assembly of the biasing member is substantially frangible, to substantially release the biasing means from the clip members proximate the attachment assembly, and, to in turn, restrain the biasing means relative to the clip members solely with the secondary attachment assembly.

In another preferred embodiment, the clip has a substantially "T" shaped configuration. In another embodiment, each of the clip members, the attachment assembly and the biasing member comprise a single integrally molded member.

In yet another preferred embodiment, the attachment assembly comprises a rod assembly associated with one of the clip members and at least one receiving opening associated with the other of the clip members. The rod is capable of receipt and engagement with the at least one receiving opening, to, in turn, facilitate pivoting of the clip members about the rod.

Preferably, the attachment assembly comprises at least one tab associated with one clip member and at least one slot associated with the other clip member. The clip members are capable of pivoting about the at least one tab and slot relative to each other.

In yet another preferred embodiment, the biasing member is retained within the confines of the side edges of the clip members.

In another aspect of the invention, the invention comprises a clip apparatus. The clip apparatus comprises a pair of clip members, a biasing member and an attachment assembly. Each of the clip members include a proximal and distal end. The biasing member is integrally molded with each of the pair of clip members proximate the proximal end thereof, and is pivotably associated with the clip members. The attachment assembly is capable of attaching the clip members to each other between the proximal and distal ends thereof, to, in turn, facilitate the pivoting of the clip members relative to each other.

In one embodiment, the attachment assembly is molded with the pair of clip members. Preferably, the distal end of at least one of the pair of clip members comprises a material that is softer than a remaining portion of the respective clip member.

In a preferred embodiment, the biasing member comprises a central region and a pair of opposing leg regions extending from the central region, the opposing leg regions being attached at ends spaced away from the central region to a respective clip member of the pair of clip members.

Preferably, in such an embodiment, the central region includes a radius of curvature such that the opposing leg regions, in an unbiased condition are substantially oblique to each other.

BRIEF DESCRIPTION OF THE DRAWINGS

The invention will now be described with reference to the drawings wherein.

DETAILED DESCRIPTION OF THE INVENTION

Figure 1:
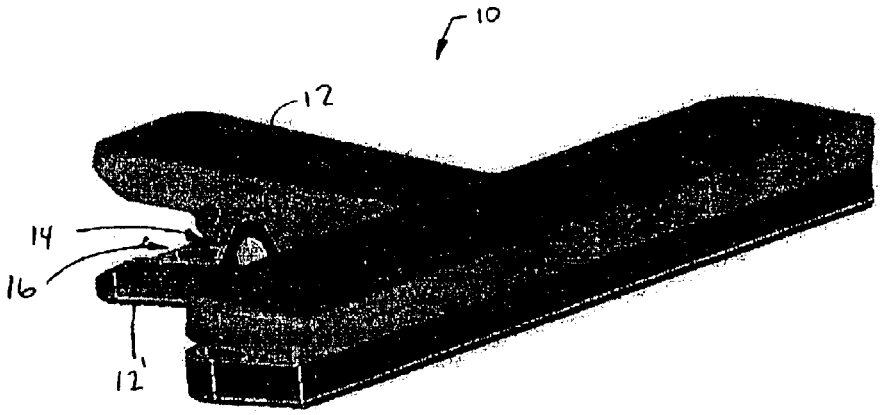
FIG. 1 of the drawings is a perspective view of the clip apparatus of the present invention.

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, clip apparatus 10 is shown in an assembled state as comprising opposing clip members 12, 12', attachment assembly 14 and biasing member 16. Preferably, clip apparatus 10 comprises a single integrated member which can be molded in a conventional two piece mold. Of course, the invention is not limited to a single integrated member, and other multiple configurations.

Inasmuch the clip members are substantially identical, clip member 12 will be described in detail with the understanding the clip 12' is substantially identical in configuration.

Moreover, the same reference numbers will be utilized for each of clip 12 and clip 12', however, those reference numbers associated with clip 12' will be augmented with a prime (').

Figure 2:
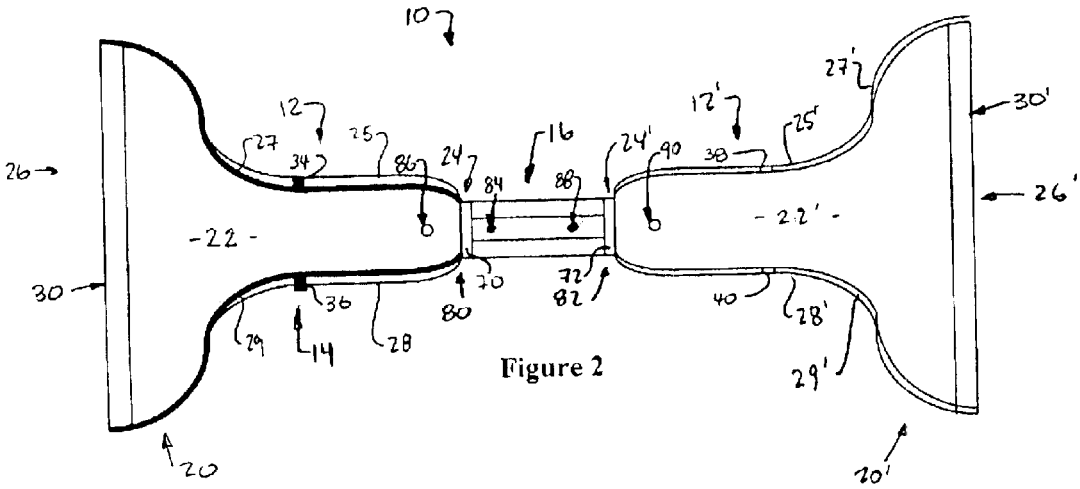
FIG. 2 of the drawings is a top plan view of the clip apparatus of the present invention shown in an unassembled condition.

Referring now to FIG. 2, clip member 12 includes body 20. Body 20 comprises a substantially planar material having outer surface 21 (FIG. 3) and inner surface 22. Body 20 may comprise a substantially uniformly thick plastic material (HDPE, PET, LDPE, ABS, etc), while other materials such as metals and composites, among others, are likewise contemplated for use. In addition, while body 20 is shown as being substantially "T" shaped, it will be understood that other configurations and shapes are contemplated for use, and the invention is certainly not limited to any particular shape. Additionally, body 20 may include recesses, slots, openings and/or other surface configurations to accommodate devices for attachment of the clip apparatus to outside structures. Such devices include magnets, hook and loop fasteners, suction cups, among others.

Inner surface 22 and outer surface 21 extend from proximal end 24 to distal end 26, each of which culminate in a proximal edge and a distal edge. Further, the inner and outer surfaces include side edges 25, 28. As will be explained, biasing member 16 is attached to body 20 at proximal end 24 thereof. Additionally, distal end 26 includes gripping region 30 of body 20. The dimensions of gripping region 30 can be varied, i.e., 4 or more inches when used as a bag or chip clip, less than an inch when used to retain garments on a hanger. Of course, the gripping region is not limited to any particular configuration or orientation.

In the embodiment shown, gripping region 30 may comprise a co-molded material which is generally softer than the surrounding material, to, in turn, promote increased gripping and retaining of an object to be retained. Of course, the invention is not limited to a co-molded material. For example, in other embodiments, the gripping region may include a separate member which is releasably or permanently attached to body 20 (i.e., a tubing member, such as a vinyl tubing member, extending across the distal end of each clip member wherein the tubing member is retained within a channel formed upon each inner surface of the clip members proximate the distal end). The gripping region may further include a serrated configuration or another surface configuration which aids in the retention of an object to be grasped by the gripping region.

Figure 3:
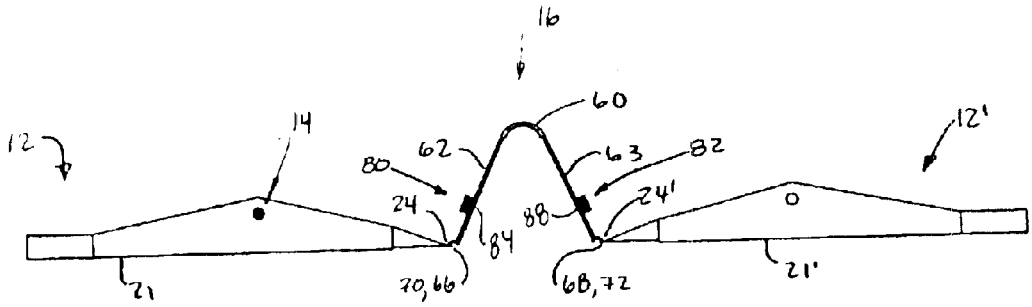
FIG. 3 of the drawings is a side elevational view of the clip apparatus of the present invention shown in an unassembled condition.
Figure 4:
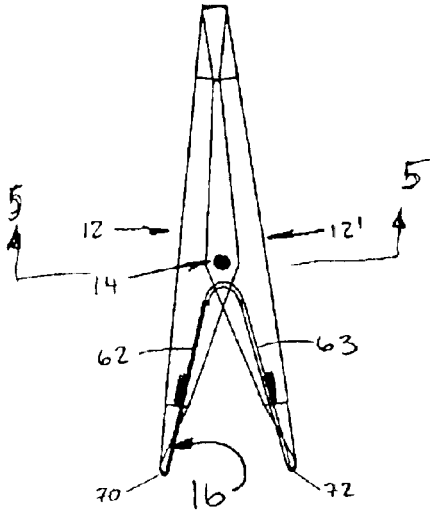
FIG. 4 of the drawings is a side elevational view of the clip apparatus of the present invention shown in an assembled condition.

Opposing side walls 27, 29 extend proximate side edges 25, 28, respectively, of body 20. The side walls extend from proximal end 24 to distal end 26. As can be seen in FIGS. 3 and 4, the side walls have varying heights along the length thereof. The side walls provide a certain rigidity to body 20, and, as such a greater number of side walls, and a variety of different configurations are contemplated for use (i.e., disjointed side walls, continuous side walls, irregularly shaped side walls, etc.).

Figure 5:
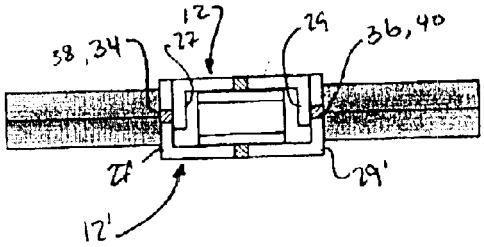
FIG. 5 of the drawings is a cross-sectional view of the clip apparatus of the present invention taken about lines 5—5 of FIG. 4.
Figure 6:
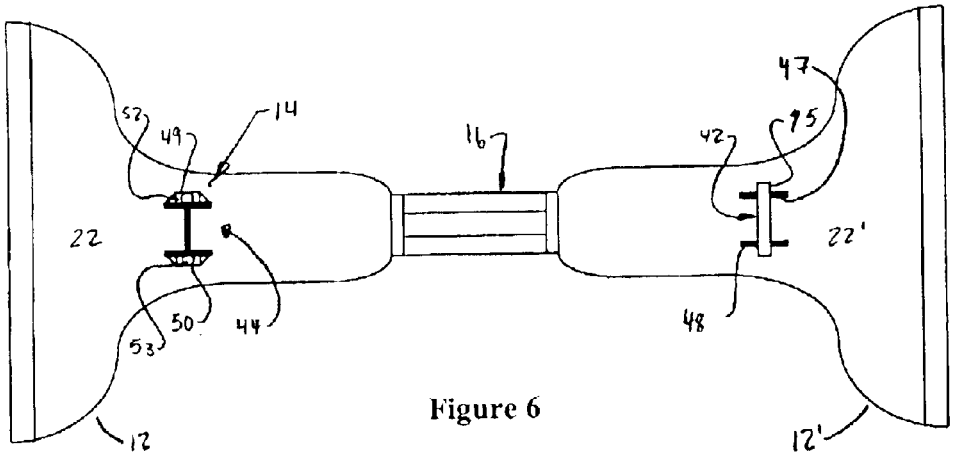
FIG. 6 of the drawings is a top plan view of another embodiment of the clip apparatus of the present invention shown in an unassembled condition.
Figure 7:
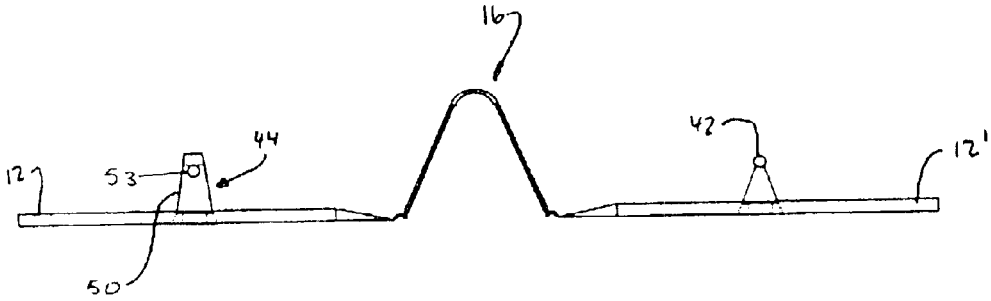
FIG. 7 of the drawings is a side elevational view of the clip apparatus of the present invention shown in an unassembled condition.
Figure 8:
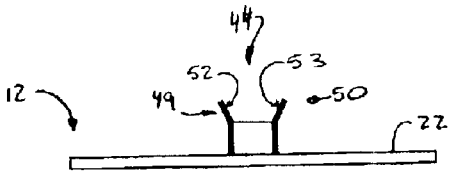
FIG. 8 of the drawings is a front elevational view of clip apparatus of the present invention shown in an unassembled condition.
Figure 9:
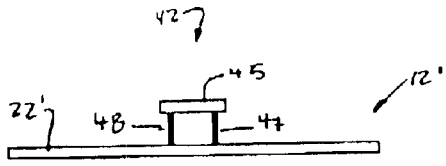
FIG. 9 of the drawings is a rear elevational view of a clip apparatus of the present invention shown in an unassembled condition.

As is shown in FIGS. 1 and 5, the side walls of clip 12 and the side walls of clip 12' are positioned relative to the respective side edges such that the side walls of clip 12 and the walls of clip 12' can nest when the clips are placed in abutment, such that the respective side walls do not interfere with each other. Referring specifically to FIG. 5, side walls 27, 29 are nested within side walls 27', 29' when the clip members are placed in abutment. As will be explained below, the side walls may form the platform for the attachment assembly.

Attachment assembly 14 is shown in FIG. 1 as comprising tabs 34, 36 and slots 38, 40. Tab 34 is positioned on the outside surface of side wall 27. Similarly, tab 36 is positioned on the outside surface of side wall 29. Slot 38 is positioned on the inside surface of wall 27', and, slot 40 is positioned on the inside surface of wall 29'. It is contemplated that the slots 38, 40 may extend through the respective side walls (i.e., openings through the side walls). The tabs and slots may include recesses or other surface configurations which further aid in the assembly of the respective tabs and slots.

The slots and tabs are positioned at strategic locations between the proximal end and the distal end such that when assembled, the tabs can be positioned within the slots. In turn, the tab and slot combination forms the fulcrum of the respective pivoting of clip member 12 and clip member 12'. Of course, other structures can be positioned in the respective side walls to achieve the pivoting attachment of clip member 12 and clip member 12'. It will be understood that the distance between the pivoting axis and the inner surfaces of the clip members substantially defines the range of rotation of the two clip member relative to each other.

In another embodiment which is shown in FIGS. 6 through 9, attachment assembly 14 may comprise rod assembly 42 associated with inner surface 22' of clip member 12' and receiving assembly 44 associated with inner surface 22 of clip member 12. Rod assembly 42 includes struts 47, 48 and rod 45 extending therebetween. Rod 45 extends beyond struts 47, 48. Receiving assembly 44 includes opposing walls 49, 50. Each of the opposing walls 49, 50 include corresponding receiving openings 52, 53, respectively, extending therethrough. It will be understood that when clip member 12 and clip member 12' are positioned in abutment, the opposing ends of rod 45 outwardly direct opposing walls 49, 50 and facilitate the directing of rod 45 into the receiving openings 52, 53.

While two exemplary attachment assemblies are shown in FIGS. 1 through 5 and FIGS. 6 through 9, it is likewise contemplated that a variety of different attachment assemblies can likewise be utilized, including, but not limited to conventional pin type hinges, or other assemblies which permit the rotation of clip member 12 and clip member 12' relative to each other about an axis of rotation positioned between the proximal and distal ends thereof.

Biasing member 16 is shown in FIGS. 2, 3 and 4 as comprising central region 60 and opposing leg regions 62, 63 extending therefrom. The central regions comprises an outwardly concave structure which may have a predetermined included angle or a predetermined radius of curvature. The leg regions, in an unbiased condition are substantially oblique to each other. While not limited to any particular angle of orientation, it is contemplated that the leg regions, in an unbiased condition, may be at an angle of about 20° to an angle of about 90°. Of course, greater or lesser angles of orientation are contemplated.

Referring now to FIG. 3, each of the leg regions 62, 63 further include attachment assemblies 66, 68, respectively. Attachment assembly 66 comprises hinge 70 for attaching leg region 62 to proximal end 24 of clip member 12, and attachment assembly 68 comprises hinge 72 for attaching leg region 63 to proximal end 24' of clip member 12'. The respective hinges comprise molded live hinges. Of course, other assemblies (i.e., pin type hinges, etc.) are contemplated for use. However, from an ease of assembly, an integrally molded hinge is preferred.

To vary the operation of the biasing member (i.e., to alter the force with which the biasing member imparts rotation of the clip members), the opposing leg regions can be lengthened or shortened. Advantageously, in the embodiment of FIGS. 1 through 5, inasmuch as the side walls 27, 29 are utilized as the structural base for the attachment assembly, the region between the side walls is substantially unobstructed from proximal end 24, 24' of bodies 20, 20' to distal end 26, 26' thereof. As such, the opposing leg regions are limited in length by the length of the body. Additionally, the radius of the central region 60 can be varied to achieve differing spring constants. Moreover, the thickness of the central region and the opposing leg regions can be varied to alter the characteristics of the biasing member.

While not required in each embodiment, as is shown in FIGS. 2 and 3, each of the leg regions 62, 63 may include supplemental attachment assembly 80, 82, respectively. Supplemental attachment assembly 80 comprises post 84 associated with leg region 62 and hole 86 positioned on inner surface 22. Similarly, supplemental attachment member comprises post 88 and hole 90. When assembled, the posts 84,88 extend through the respective hole 86, 88, and, the posts are releasably retained therein by way of the biasing action of the biasing member. Of course, it is contemplated that the posts may be positioned on the clip member, and the holes may be positioned on the opposing leg regions.

The supplemental attachment assembly can be employed as an additional safety measure, inasmuch as the supplemental attachment assembly can preserve operation of the system in the event that either of the attachment assemblies 66, 68 fail. In other embodiments, it is contemplated that the attachment assemblies 66, 68 may be frangible, and that the supplemental attachment assembly becomes the sole attachment assembly for attachment of the biasing member to the clip members. Moreover, the supplemental attachment assembly is further augmented by the opposing side walls of the clip members inasmuch as the opposing side walls substantially capture the biasing member therebetween.

To manufacture the clip apparatus, it is desirable to mold the two clip members, the attachment assembly and the biasing member as a single integrated molded member. The molded member has a configuration like that which is shown in FIGS. 2 and 3. While not required, it is preferred that gripping region 30 and 30' may further include a co-molded member which is slightly softer than the remainder of the respective bodies 20, 20'. Such a configuration facilitates the gripping of relatively irregular objects and irregular surface configurations.

Once the clip apparatus is molded, the clip apparatus can be removed from the mold. Once removed, the respective clip members are positioned such that the inner surfaces 22, 22' substantially face each other, and that the portions of the attachment assembly 14 positioned on each of the clip members substantially correspond. The attachment assembly is then fully assembled to pivotally join the two clip members. Specifically, tabs 34, 36 of the attachment assembly are positioned within corresponding slots 38, 40. Or, in the alternative embodiment, rod 45 is directed into openings 52, 53.

Referring to FIG. 4, the positioning of the clip members into the desired position for assembly of the attachment assembly, automatically rotates biasing member 16 about hinges 70, 72, to in turn position the biasing member between the inner surfaces of the clip members. Furthermore, once the attachment assembly is assembled, the biasing member serves to exert an outward force upon the proximal ends 24, 24' of each clip member, thereby forcing the distal ends 26, 26' toward and into contact with each other. By varying the biasing member characteristics, the force with which the distal ends are forced into each other can be varied.

Advantageously, inasmuch as in the preferred embodiment, the biasing member and the clip member are molded in single operation, the assembly and the operation of the device is substantially facilitated. In particular, whereas with conventional devices a multitude of components are required, and each of the components must be assembled by relatively skilled assemblers, the device of the present invention requires only a single manipulation and assembly to assemble the entire structure. In turn, the assembly time and the difficulty of assembly is greatly simplified. Additionally, even when not constructed from a single integrated molded member, the clip apparatus of the present invention facilitates the use of a common material for each of the components of the apparatus.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A clip apparatus comprising:

a pair of opposing clip members, each clip member including:

an outer surface and an inner surface opposing the outer surface;

a proximal end and a distal end spaced apart from the proximal end; and side edges extending substantially from the proximal end to the distal end;

the clip member further includes side walls extending about either side edge of the respective clip member at least partially between the proximal end and the distal end of the respective clip member, the side walls positioned such that at least a portion of the side walls of one of the clip members can be nested relative to at least a portion of the side walls of the other of the clip members; and an attachment assembly capable of attaching the pair of opposing clip members between the proximal and distal ends thereof, the attachment assembly further comprising at least one slot associated with one of the side walls of one clip member and at least one tab associated with an adjoining side wall of the other clip member, the at least one slot interfacing with the at least one tab so as to facilitate pivoted rotational engagement of the clip members relative to each other; and a biasing member, the biasing member comprising:

a central region;

a pair of opposing leg regions extending away from the central region;

an primary attachment assembly capable of pivotably attaching the opposing leg regions to opposing clip members substantially about the proximal end thereof, the primary attachment assembly comprises a first hinge integrally molded to one of the pair of opposing leg regions and to one of the clip members at a proximal edge thereof, and a second hinge integrally molded to the other of the pair opposing leg regions and to the other of the clip members at a proximal edge thereof; and a secondary attachment assembly, the secondary attachment assembly positioned between the distal end of the clip members and the hinges, the secondary attachment assembly facilitating operation of the apparatus upon separation of at least one of the first hinge and the second hinge, wherein upon assembly of the clip apparatus, the biasing member substantially biases against the proximal ends of the respective clip members, to, in turn, force the distal ends of the respective clip members into abutment.

2. The clip apparatus of claim 1, wherein each of the side walls of one clip member include at least one tab, and each of the side walls of the other clip member include at least one slot, the tabs of one clip member interfacing with the slots of the other clip member, to facilitate pivoted rotational engagement of the clip members relative to each other.

3. The clip apparatus of claim 1 wherein the distal end of at least one clip member comprises a material softer than the remainder of the at least one clip member.

4. The clip apparatus of claim 1 wherein the secondary attachment assembly further comprises one of a hole and a post associated with each of the opposing leg regions and the other of a hole and a post associated with each of the respective clip members, whereupon assembly of the clip apparatus, the respective holes and posts interface with each other to facilitate attachment of the biasing member to the clip members.

5. The clip apparatus of claim 1 wherein the primary attachment assembly of the biasing member is substantially frangible, to substantially release the biasing member from the clip members proximate the primary attachment assembly, and, to in turn, restrain the biasing means relative to the clip members solely with the secondary attachment assembly.

6. The clip apparatus of claim 1 wherein the clip has a substantially "T" shaped configuration.

7. The clip apparatus of claim 1 wherein each of the clip members, the attachment assembly and the biasing member comprise a single integrally molded member.

8. The apparatus of claim 1 wherein the biasing member is retained within the confines of the side edges of the clip members.

9. A clip apparatus comprising:

a pair of clip members each having a proximal end and distal end;

an attachment assembly attaching the clip members to each other between the proximal and the distal ends thereof, to in turn, facilitate the pivoting of the clip members relative to each other a biasing member integrally molded with each of the pair of clip members at a hinge proximate the proximal end thereof, the biasing member including a pair of leg members each coupled to one of the pair of clip members and joined at one end thereof by a hinge, the biasing member being pivotable relative to the clip member between a first orientation wherein the distal ends of the pair of clip members substantially abut each other to second orientation wherein the distal ends of the pair of clip members are substantially separated, the biasing member further comprising a supplemental attachment assembly cooperatively coupling the biasing member with the proximal end of each of the clip members, the supplemental attachment assembly comprising a first member positioned on each of the pair of the clip members and a second member positioned on each respective leg member spaced apart from the attachment assembly, wherein the first and second members are releasably engageable, the supplemental attachment assembly configured such that upon separation of the biasing member from the proximal end of the respective clip member at the respective hinge, the supplemental attachment assembly maintains the biasing member in position relative to the pair of clip members to facilitate operation of the clip members between the first orientation and the second orientation; and an attachment assembly attaching the clip members to each other between the proximal and distal ends thereof, to, in turn, facilitate the pivoting of the clip members relative to each other.

10. The clip apparatus of claim 9 wherein the attachment assembly is molded with the pair of clip members.

11. The clip apparatus of claim 9 wherein the distal end of at least one of the pair of clip members comprises a material that is softer than a remaining portion of the respective clip member.

12. The clip apparatus of claim 9 wherein the attachment assembly comprises a rod assembly associated with one of the clip members and at least one receiving opening associated with the other of the clip members, wherein the rod is capable of receipt and engagement with the at least one receiving opening, to, in turn, facilitate pivoting of the clip members about the rod.

13. A clip apparatus comprising:

a first and second clip member each having a proximal end and a distal end;

an attachment assembly pivotably attaching the clip members to each other between the proximal and distal ends thereof;

a biasing member integrally molded with each of the clip members, the biasing member comprising a first leg region, a second leg region and a central region, the first leg region connected to the first clip member by a hinge at the proximal end thereof and coupled to the central region, the second leg region connected to the second clip member by a hinge at the proximal end thereof and coupled to the central region, the central region being positioned between the proximal end and the attachment assembly; and a supplemental attachment assembly comprising one of a post and a hole associated with the each of the first and second leg regions, and the other of a post and a hole associated with each of the first and second clip members spaced apart from the attachment assembly, wherein the post and hole arrangement between the respective leg regions and clip members are capable of releasable engagement, to, maintain operative engagement of the biasing member relative to the clip members, in turn, providing for operation of the biasing member in the event that the hinge associated with either of the first and second leg regions fails.

* * * * *

UNITED STATES PATENT AND TRADEMARK OFFICE

CERTIFICATE OF CORRECTION

PATENT NO. : 6,813,814 B1
DATED : November 9, 2004
INVENTOR(S) : Schultz

It is certified that error appears in the above-identified patent and that said Letters Patent is hereby corrected as shown below:

Column 1,
Line 15, delete "comprises a pair" and substitute -- comprise a pair --.

Column 2,
Line 26, after "of the pair" insert -- of --.

Column 3,
Line 50, after "view of" insert -- the --.

Column 4,
Line 14, after "Inasmuch" insert -- as --.
Line 16, delete "the clip 12" and substitute -- that clip 12' --.

Column 5,
Line 37, delete "member relative" and substitute -- members relative --.

Column 8,
Line 7, delete "an primary" and substitute -- a primary --.
Line 14, after "of the pair" insert -- of --.
Line 65, after "each other" insert -- ; and --.

Column 9,
Line 7, after "other to" insert -- a --.
Lines 24-29, after "second orientation" delete "; and an attachment assembly attaching the clip members to each other between the proximal and distal ends thereof, to, in turn, facilitate the pivoting of the clip members relative to each other --.

Signed and Sealed this

Thirty-first Day of May, 2005

JON W. DUDAS
*Director of the United States Patent and Trademark Office*